US008257172B2

(12) United States Patent
Collett

(10) Patent No.: US 8,257,172 B2
(45) Date of Patent: Sep. 4, 2012

(54) CASHLESS GAMING

(75) Inventor: Steven Collett, Burton-On-Trent (GB)

(73) Assignee: Inspired Gaming (UK) Limited (GB)

( * ) Notice: Subject to any disclaimer, the term of this patent is extended or adjusted under 35 U.S.C. 154(b) by 19 days.

(21) Appl. No.: 13/057,559

(22) PCT Filed: Jul. 27, 2009

(86) PCT No.: PCT/GB2009/001868

§ 371 (c)(1),
(2), (4) Date: Feb. 4, 2011

(87) PCT Pub. No.: WO2010/015804

PCT Pub. Date: Feb. 11, 2010

(65) Prior Publication Data

US 2011/0136570 A1 Jun. 9, 2011

(30) Foreign Application Priority Data

Aug. 5, 2008 (GB) ..... 0814306.7

(51) Int. Cl.
*A63F 9/24* (2006.01)

(52) U.S. Cl. ..... 463/29; 463/25

(58) Field of Classification Search ..... 463/16–20, 463/25–29

See application file for complete search history.

(56) References Cited

U.S. PATENT DOCUMENTS

2005/0282626 A1 12/2005 Manfredi et al.

FOREIGN PATENT DOCUMENTS

EP 1746550 A2 1/2007
WO 03035195 A1 5/2003

OTHER PUBLICATIONS

International Search Report for PCT/GB2009/001868.

*Primary Examiner* — Omkar Deodhar
(74) *Attorney, Agent, or Firm* — Caesar, Rivise, Bernstein, Cohen & Pokotilow, Ltd.

(57) ABSTRACT

It is known for a gaining machine to issue a ticket or voucher having a value or an associated value as credit. It is a problem that such information carriers may become lost or stolen and subsequently redeemed by others. In the disclosed method, a player first registers and provides a first code to a gaming establishment and a value of credit available with which to play. A ticket is issued with a generated second code. On inserting the ticket in a gaming machine, prior to gaming being permitted, the gaming machine detects the second code and requires the player to enter the first code. The gaming machine validates the codes at the machine against corresponding codes stored elsewhere and permits gaming only when at least one of the codes matches. Thus, a ticket in accordance with the present invention will not be suitable for use other than by the player to whom the information carrier belongs since a third party will not have access to either the player provided code or the generated ticket code.

48 Claims, 11 Drawing Sheets

CASHLESS GAMING

BACKGROUND OF THE INVENTION

The present invention relates to an improved method and apparatus for cashless gaming. Many such methods and apparatus are known.

For example it is known for a player to insert coins or notes into a gaming machine and upon completion of one or more wagers be presented with a ticket or voucher having a value or an associated value which may be redeemed at a suitable location such as a cashier's desk or automated cashier section. The ticket or voucher may also be retained by the player for re-use with any suitable gaming machine. However, it is a problem that such tickets or vouchers may become lost or stolen and may subsequently be redeemed by others.

It is an advantage that a ticket or voucher provided in accordance with the present invention will not be suitable for use other than by the player to whom the ticket or voucher belongs.

SUMMARY OF THE INVENTION

According to a first aspect of the present invention, a method of gaming comprises the steps of:

a) a player registering with a gaming establishment, including providing a first code to the gaming establishment and a value of credit available with which to play;

b) a second code being generated;

c) the player being issued with an information carrier provided with the second code;

d) the player inserting the information carrier in a gaming machine, the gaming machine detecting the second code and requiring the player to enter a first code, and prior to gaming being permitted on the gaming machine one of the first code entered at the machine and the second code detected at the gaming machine being validated against the first code provided on registration and the generated second code;

e) the player subsequently indicating that no further gaming is intended;

f) an updated second code being generated; and g) the gaming machine issuing a replacement information carrier having an updated second code.

It is an advantage of the present invention that absent knowledge of the first code, the first and second information carriers have no monetary value for third parties.

Preferably, for the player to redeem the replacement information carrier, the player must provide the first code.

Preferably, a server is provided and the server provides the second code, the server linking the second code and the first code in a database together with the amount of credit. This provides added security against counterfeiting since a counterfeiter will be unable to determine and so match the first code (provided by the player) and the second code (generated by the server) to produce a information carrier acceptable by a cashier.

Preferably, the gaming machine interrogates the server to ensure the first code entered by the player at the gaming machine corresponds to the first code associated with the second code at the server.

Preferably, the gaming machine includes a local memory unit, the gaming machine interrogating the server to obtain the value of credit available with which to play, storing the value of credit available in the local memory unit and modifying the value of credit available in the local memory unit as required prior to the player indicating that no further gaming is intended.

Preferably, when the player indicates that no further gaming is intended, prior to issuing the replacement information carrier having the updated second code the gaming machine communicates a value of credit available to be returned to the server, the server updates the database to replace the value of credit available in the server with the value of credit available to be returned.

Preferably the server generates the updated second code to be associated with the first code and the value of credit available to be returned and provides the updated second code to the gaming machine.

Preferably the updated second code is the same as the second code.

Preferably the gaming machine communicates the value of credit available to be returned to the server after each play of the gaming machine to enable updating of the database as well as when the player requests the value of credit available to be returned. More preferably, the updated second code is generated and returned on each occasion the gaming machine communicates the value of credit available.

According to a second aspect of the present invention, a gaming system comprises a) a server including a database, the database storing information representative of at least one player, a first code associated with the or each player, a second code associated with the or each player, and a value of credit available with which to play associated with the or each player;

b) a network; and c) one or more gaming machines, each gaming machine having at least one credit peripheral for recognizing and validating a second code provided on a information carrier, at least one payment peripheral for issuing a replacement information carrier, a network communication unit to enable communication with the server over the network, at least first input means to enable the player to provide a first code entered by the player, and a processor for managing the operation of the gaming machine including communicating with the server over the network to validate at least one of the first code entered by the player and the second code provided on the information carrier against the first code associated with the player stored in the server and the second code associated with the player stored in the server.

Preferably, on play of the gaming machine the value of credit available associated with the individual player is modified.

Preferably, each gaming machine is provided with a local memory unit in which the value of credit available associated with the individual player is stored during play of the gaming machine by the player. More preferably, prior to issue of the replacement information carrier by the payment peripheral, the processor communicates the value of credit available associated with the individual player in the local memory unit to the server to update the value of credit available associated with the individual player stored in the server.

Preferably, following each play of the gaming machine, the processor communicates with the server to update the value of credit available associated with the individual player stored in the server.

Preferably, prior to issue of the replacement information carrier by the payment peripheral, the processor communicates with the server to obtain an updated second code for the replacement information carrier.

Preferably, the updated second code for the replacement information carrier is identical to the second code associated with the individual player.

Preferably, the updated second code for the replacement information carrier is generated by a random number generator.

Preferably, the random number generator is located at the gaming machine and the processor communicates the updated second code to the server for the server to replace the second code in the database with the updated second code.

Alternatively, the random number generator is located with the server, the processor requesting the updated second code from the server and the server replacing the second code in the database with the updated second code.

BRIEF DESCRIPTION OF SEVERAL VIEWS OF THE DRAWINGS

The invention will now be described, by way of example only, with reference to the accompanying drawings, in which:—

DETAILED DESCRIPTION OF THE PREFERRED EMBODIMENTS

In the following description, reference is made to the accompanying drawings which illustrate several embodiments of the present invention. It is understood that other embodiments may be utilized and mechanical, compositional, structural, electrical, and operational changes may be made without departing from the spirit and scope of the present disclosure. The following detailed description is not to be taken in a limiting sense, and the scope of the embodiments of the present invention is defined only by the claims of the issued patent.

Some portions of the detailed description which follows are presented in terms of procedures, steps, logic blocks, processing, and other symbolic representations of operations on data bits that can be performed on computer memory. Each step may be performed by hardware, software, firmware, or combinations thereof.

It will be understood that other suitable database structures to those described may be utilised and that other suitable memory structures besides databases may be utilised. Any examples of a database given are thus illustrative of arrangements for the storage of information. Similarly, examples of network topology are illustrative and other topologies may be used.

Figure 1:
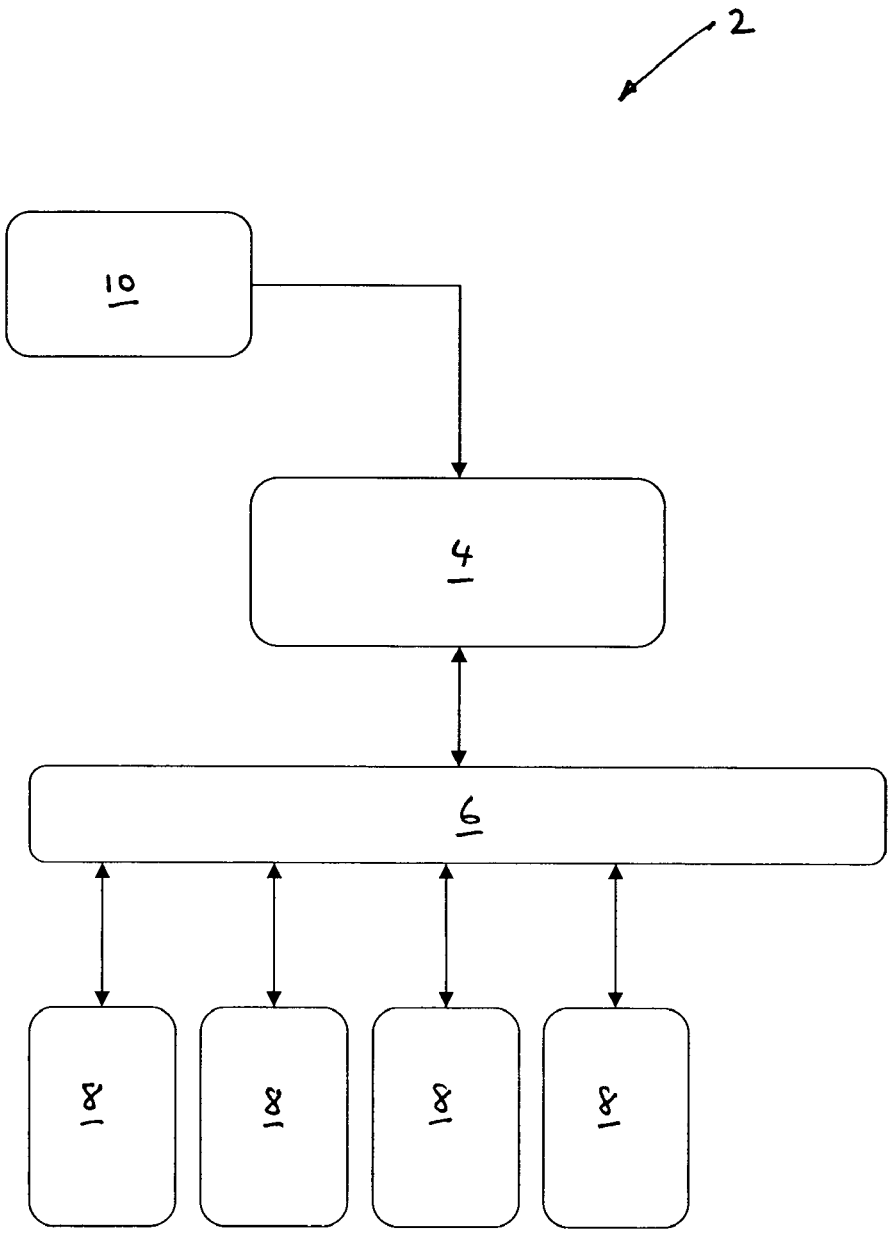
FIG. 1 shows in schematic form a gaming system for use with the present invention.

Referring to FIG. 1, there is shown a gaming system 2 suitable for implementing the present invention. A server 4 is provided, typically in an operations centre of a casino or other gaming establishment, but the server 4 could be located in other locations such as a regional data centre supporting a plurality of gaming establishments or venues in which entertainment devices such as gaming machines are located. The server 4 is connected by a communications network 6 to a plurality of entertainment devices such as gaming machines 8. Hereafter the term gaming machine is used as an example of an entertainment device. In FIG. 1, four such gaming machines are shown, though it will be understood that other numbers, for example many more, for example hundreds or thousands of machines (as the network permits) may be connected to the server through the network 6. The network 6 may comprise the Internet or any other suitable network, either wired or wireless.

For the purposes of the present invention, the server 4 comprises a database server. In practice the server may also perform other functionality or form part of a server array or server farm providing a variety of functionality.

The server 4 typically includes or is in communication with a code generator such as a random number generator. The server 4 is additionally in communication with a management computer 10 by which information may be added to the database subject to suitable authorisation and permission controls as will be understood by those familiar with such technology. The management computer 10 is shown in FIG. 1 as being directly connected to the server 4, but more typically the management computer 10 will access the server 4 by way of a connection over a network. The management computer may itself include additional peripherals such as a keyboard, a scanner and a printer.

Figure 2:
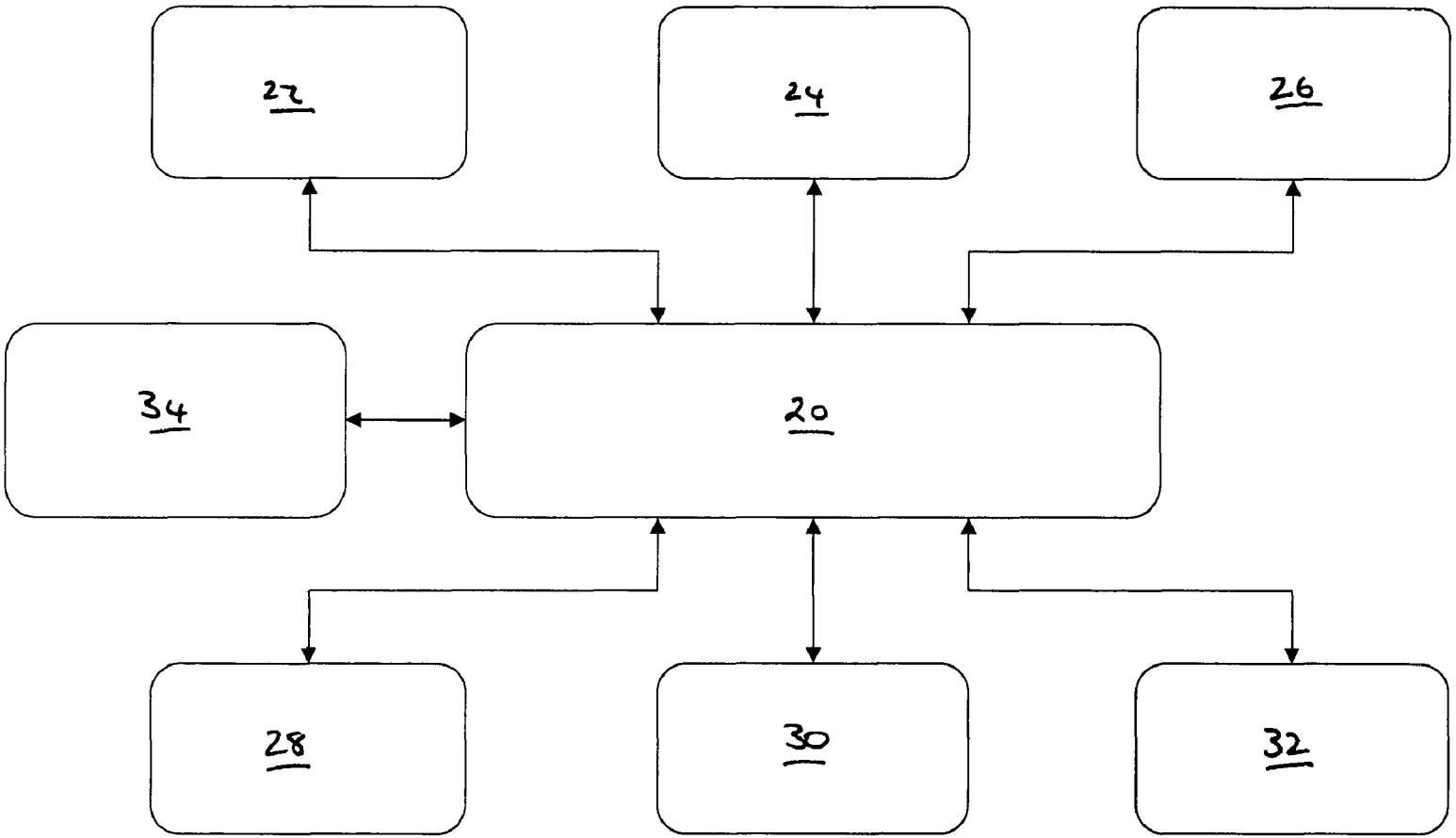
FIG. 2 shows in schematic form elements for use in a gaming machine in accordance with the present invention.

Elements of a gaming machine 8 suitable for use with the present invention are shown in FIG. 2. The gaming machine 8 includes a main processor running a suitable operating system for managing a plurality of peripherals. One such peripheral is a display unit 22 for presenting a game to a player. Such a display unit 22 may take the form of a cathode ray tube, an LCD display a plasma screen or other suitable display. A credit unit 24 which controls and validates payments from one or more payment peripherals is also included. Such payment peripheral(s) include at least one reader for reading an information carrier and may also include a coin acceptor, note acceptor, credit card or debit card reader or other electronic payment interface. The gaming machine 8 is also provided with a payment unit 26 which controls and validates payments from payment peripherals to enable payment of any remaining credit. Such payment peripheral(s) include at least one information carrier generator and may also include a coin dispenser, a note dispenser, a card writer or an electronic payment interface.

The gaming machine 8 further includes output means 28 such as speakers and light arrays for the generation of audio and visual stimuli for players and prospective players.

The gaming machine also includes input means 30 such as buttons, a keypad or a touchscreen. The input means 30 may comprise a selection from these and other examples of suitable input means.

Each gaming machine 8 is also provided with a network connection 32 to enable the processor 20 to communicate with the server 4 over the network 6.

The gaming machine 8 typically comprises a local memory unit 34. Conveniently gaming software may be stored in the local memory unit 34. Conveniently such gaming software may be updated and/or replaced over the network 6.

Figure 3:
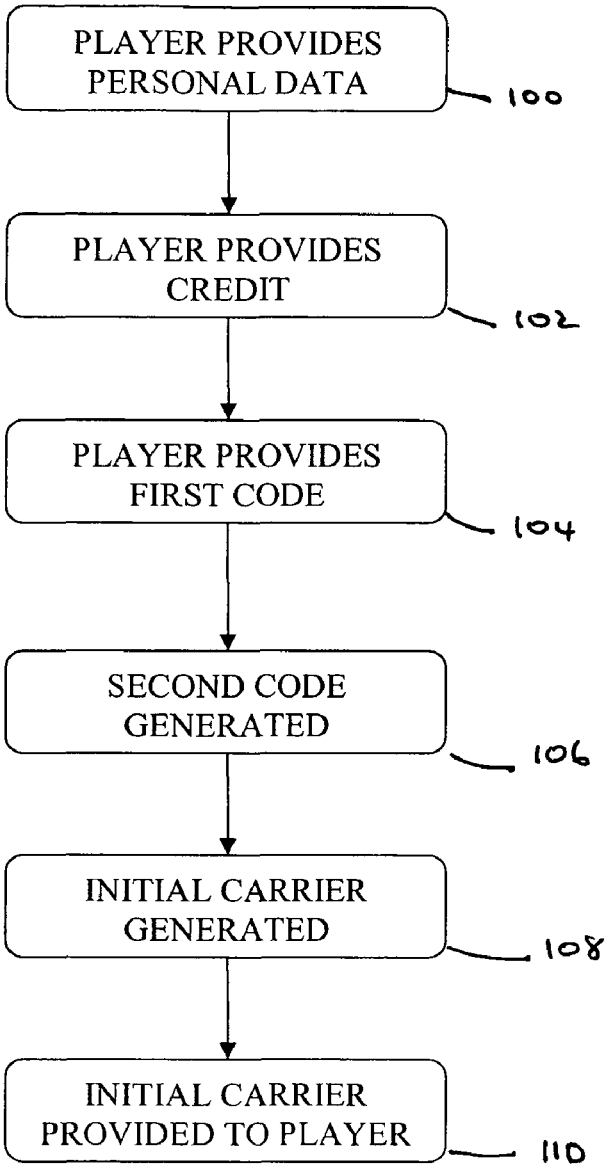
FIG. 3 shows a flowchart illustrating steps in the generation of an initial information carrier according to the method of the present invention.

Should a patron of a gaming establishment, hereafter a player, wish to take advantage of the present invention, it will be necessary first for the player to enrol. For example, the player first makes themself known to a cashier and is provided with a form for completion (step 100, FIG. 3). The form is preferably in machine readable form. In completing the form, the player provides a variety of items of personal information. This information may include information suitable for marketing purposes, such as a mailing address of the player, as well as other information suitable for enabling the correct identification of the player, such as appearance details or other personal data. The information is provided to the server 4 to create an account for the player and to identify the player on future occasions.

On this occasion the player also provides credit to the gaming establishment either by payment of currency, by electronic transfer or any other suitable means (step 102). The value of this credit available with which to play is also stored in the database.

The player will also be required to provide a first code (step 104). The first code is chosen by the player. The first code may comprise an alphanumeric password. Preferably, the first code is restricted in length to four or five characters.

In an alternative embodiment, the form may be in electronic form requiring completion (either by the player or the cashier in response to answers provided by the player), on a terminal, for example the management computer, in communication with the server. However, to maintain the security of the first code it is preferred that the player enters this information themselves.

Figure 3A:
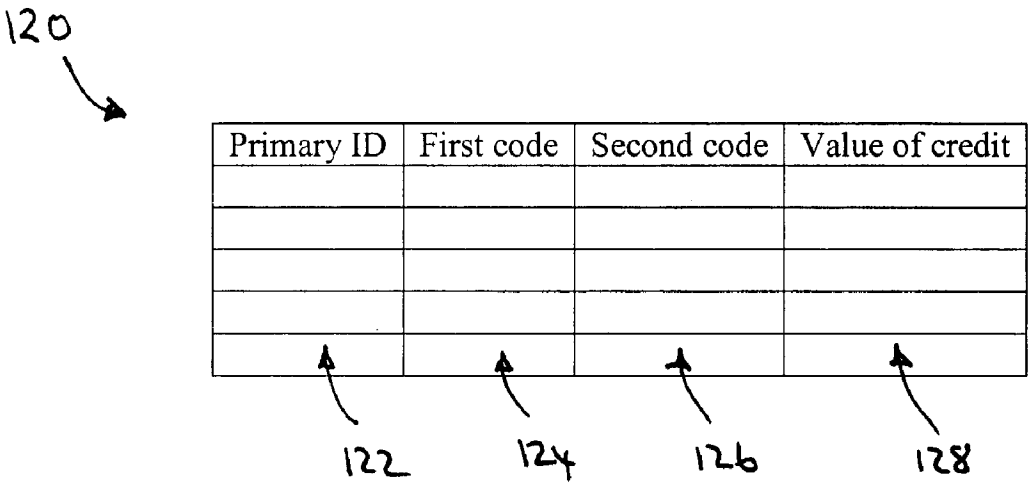
FIG. 3*a* shows an example table for use in a database for use in the method of the present invention.

Next, the code generator generates a second code to be associated with the account of the player (step 106). A suitable database table 120 for use with the present invention is shown in FIG. 3A. A primary ID representative of a player account is shown in a first column 122. The first code chosen by the player is stored in a second column 124. The second code generated for the player is stored in a third column 126. The value of credit available to the player with which to play is stored in a fourth column 128. In an alternate embodiment, the second code may be used as the primary ID representative of the player account.

An information carrier, such as a ticket or voucher, is generated by a suitable output peripheral, for example in a preferred embodiment the information carrier is a paper ticket or voucher generated by a printer (step 108). The information carrier bears coding identifying the information carrier, for example by reference to the second code. The coding may be an alphanumeric representation of the second code, a barcode representing the second code or another representation of the second code. As will become apparent, the coding does not need to represent the credit available to the player. However, for the benefit of the player, the value of credit available to the player may be displayed on the information carrier for reading by the player.

The information carrier is then provided to the player for use with suitable gaming machines in the gaming establishment (step 110).

Figure 4A:
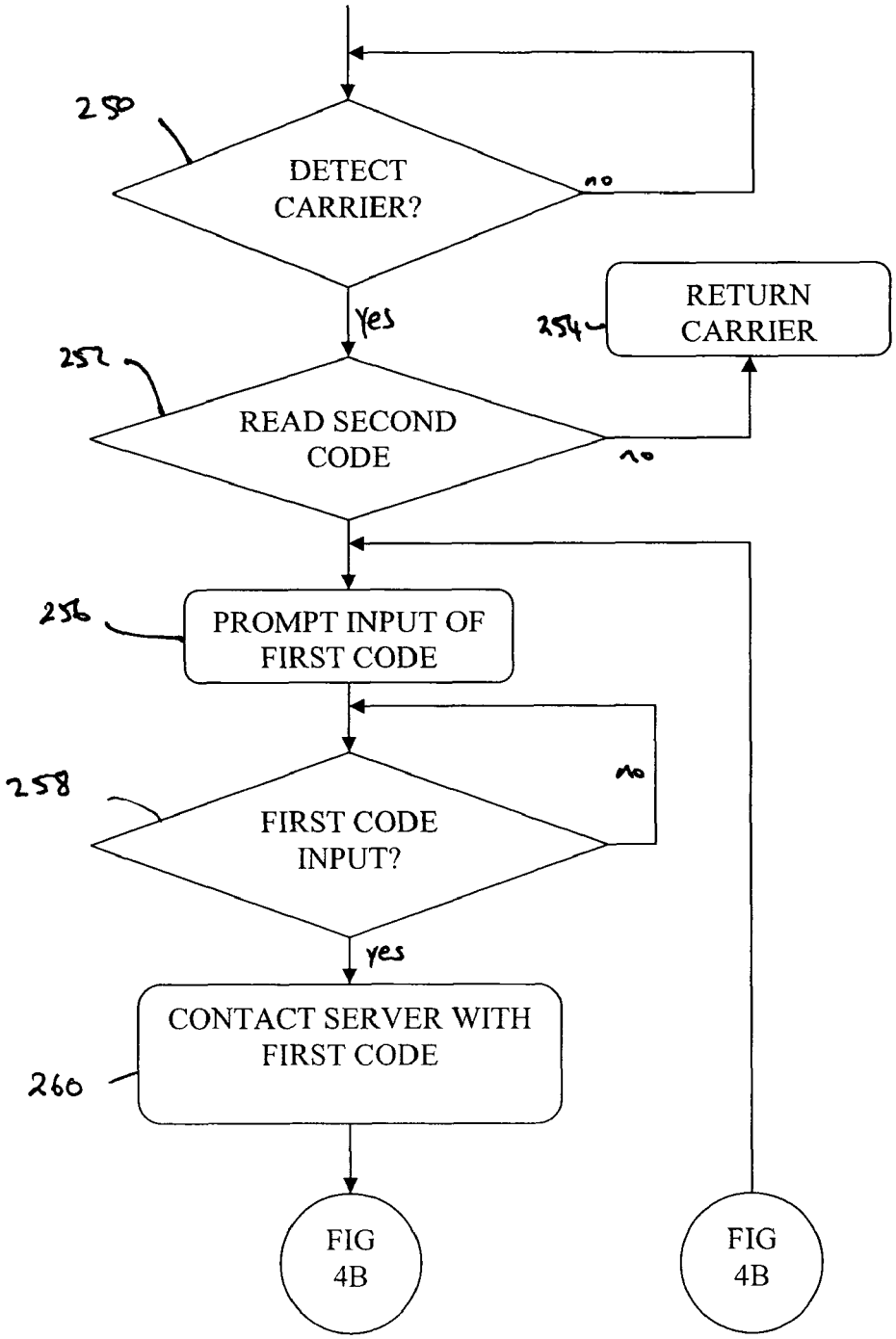
FIGS. 4*a* and 4*b* shows parts of a flowchart illustrating steps in the use of a information carrier to permit gaming according to the method of the present invention.
Figure 4B:
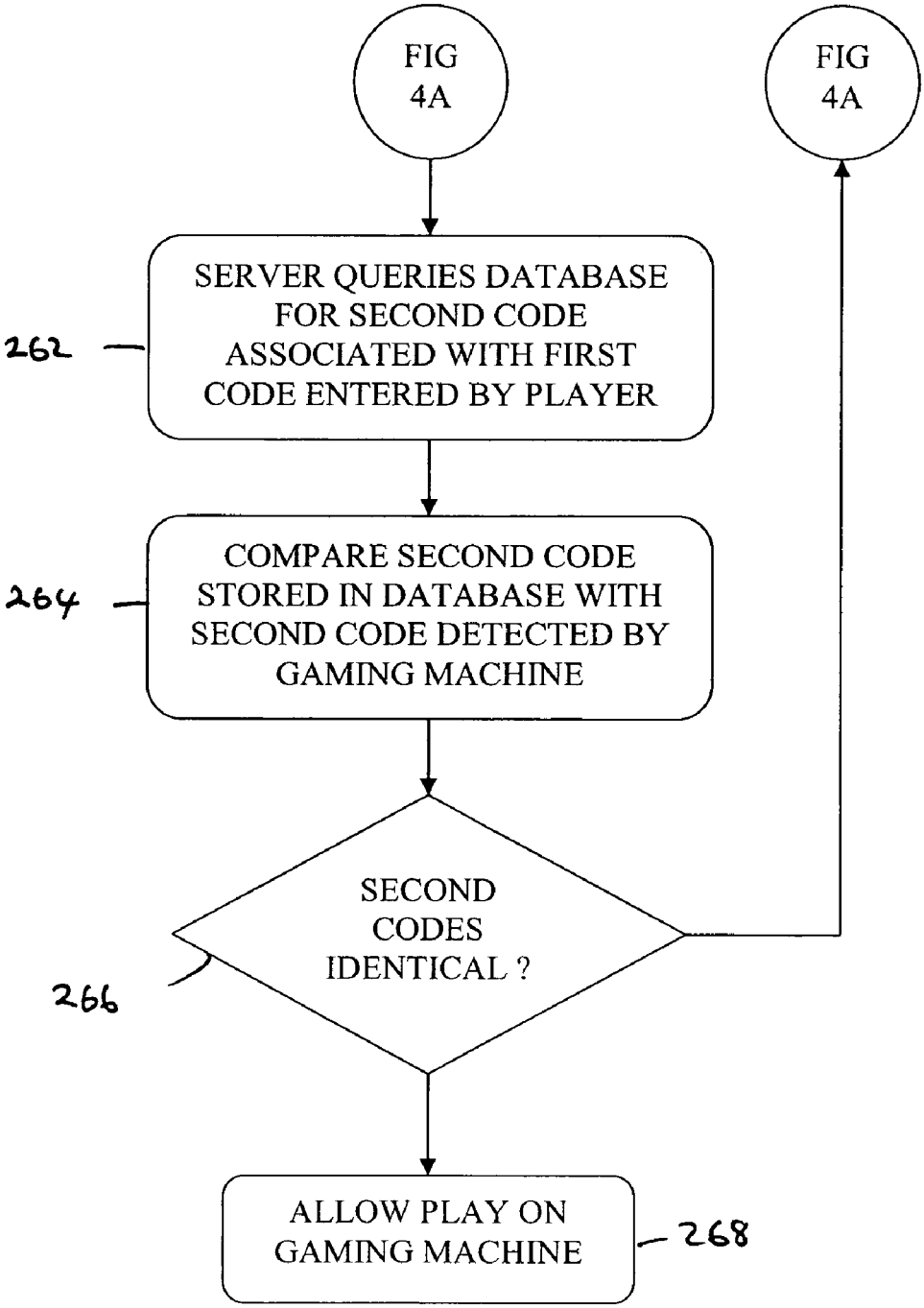

In order to play a gaming machine, the player selects a desired gaming machine 8 and inserts the information carrier. The gaming machine 8 detects the presence of the inserted information carrier (step 250, FIG. 4A) and then reads or otherwise detects the second code (step 252). For example an optical character reader may read an alphanumeric code or a scanner of known type may read a barcode.

If the second code cannot be detected, the information carrier is returned to the player (step 254). Conveniently, the display unit 22 and/or the output means 28 may be used to communicate to the player why the information carrier is being returned and to advise the player to seek assistance for example from a staff member of the gaming establishment.

Once the information carrier has successfully been read and the second code detected, the player is prompted, for example by way of the display unit 22 and/or the output means 28 to enter the first code (step 256). For ease of recall by the player, the first code is typically a short alphanumeric password or a four to six digit numerical code.

The first code may be entered by the player by use of any suitable input means. such as by pressing suitable marked areas of a touch sensitive screen, by pressing buttons indicated by the display to represent numbers or letters (or by pressing buttons to scroll though a display to the correct number or letter) and pressing another button (such as a "play" button) to confirm entry of the first code (or individual first code elements) (step 258).

If the first code is not entered, the gaming machine continues to prompt the player. Preferably, the prompt must be responded to within a predetermined time or the information carrier is returned to the player. Conveniently, the display unit 22 and/or the output means 28 may be used to communicate to the player why the information carrier is being returned and to advise the player to seek assistance, for example from a staff member of the gaming establishment.

Once the first code has been entered, the processor 20 contacts the server 4 and provides the server 4 with the first code (step 260). The server 4 then interrogates the database for the second code associated with the first code provided by the gaming machine and returns this second code to the gaming machine (step 262).

A comparison of the second code read by the gaming machine and the second code provided by the database is made (step 264). If the second codes do not correspond, the player may again be prompted to enter the first code (step 266). For example a player may have incorrectly recalled the first code or incorrectly entered the first code. However, to prevent fraud, the player is provided only with a set number of attempts to enter the first code correctly. If the set number of attempts is made and the first code is not correctly entered, the information carrier will be retained and a suitable information message displayed or otherwise conveyed to the player. Additionally, the gaming machine may signal (by any suitable means) for security to attend the machine.

If the second codes are identical, the processor will permit the player to play on the gaming machine 8 (step 268).

It will be understood that the gaming machine may instead send the second code to the server, requesting the first code for comparison. Alternatively, the gaming machine may communicate one or both of the first and second codes to the server, the server making the comparison between the code or codes provided from the gaming machine and the code or codes retained in the database, the server returning a signal indicative of appropriate action, for example to allow play or retain the information carrier and communicate a suitable information message to the player and/or alert security.

Once the information carrier has been validated, the database may also record the time of use of the information carrier and details of the machine into which the information carrier was inserted. Due to the communication of the gaming machine with the server (as will be described) data regarding the amount wagered and the time spent wagering by the player may be recorded and accumulated in the database. This data may be used to identify a profile of the player including, but not limited to, indications of the player's favoured kind of wager, allowing the player to participate in a loyalty scheme (such as a player point scheme) or other bonus scheme. The data may also be checked against known data profiles for example to detect wagering patterns indicative of problem gambling, thereby enabling the gaming machine to communicate a suitable notification to the player to seek to cause the player to modify such wagering patterns.

In the event that play is allowed several alternate embodiments are now described.

Figure 5A:
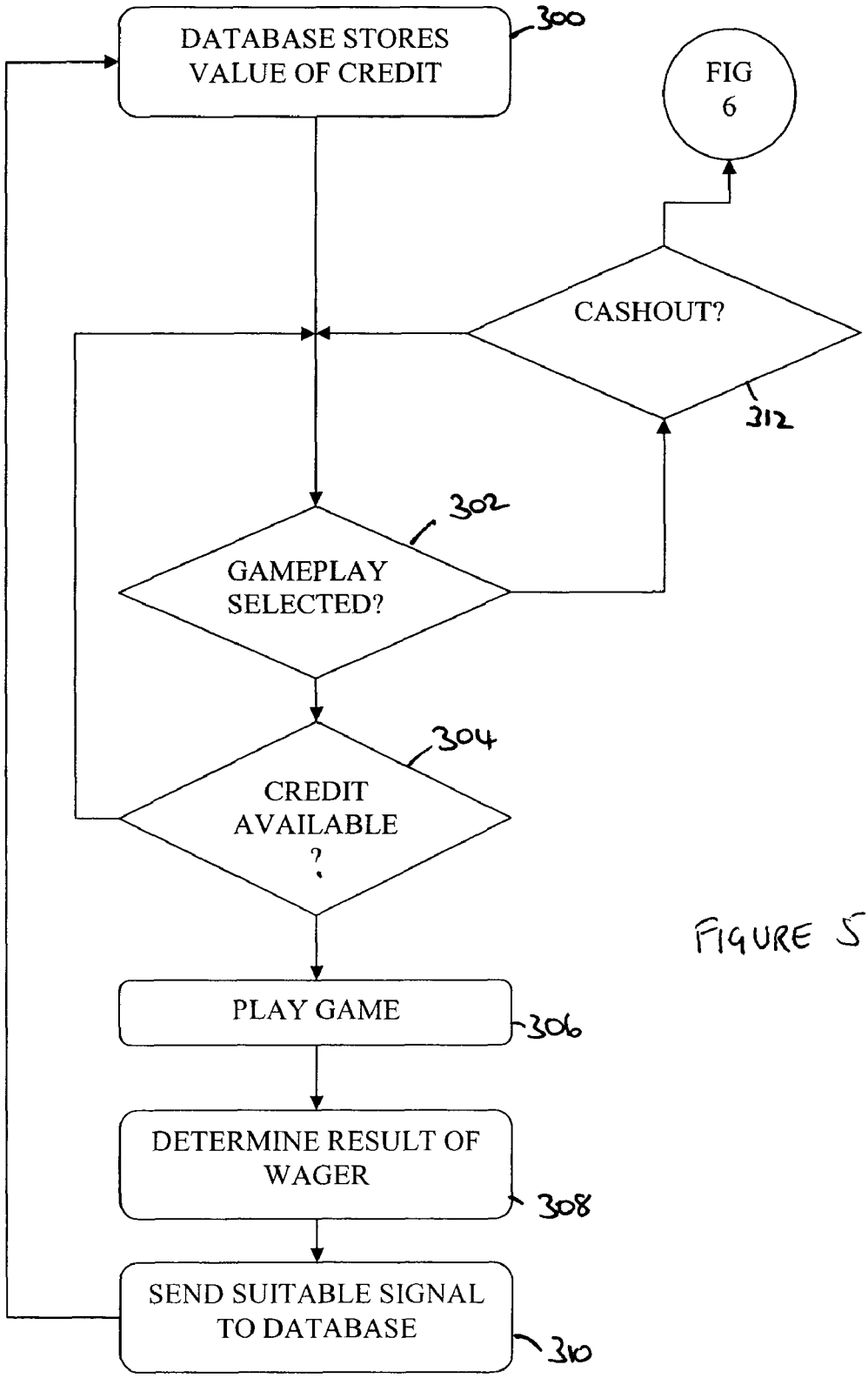
FIG. 5*a* shows a flow chart illustrating steps during play in a first embodiment of the present invention.

In a first embodiment (FIG. 5A) the value of credit is stored in the database held on the server 4 only (step 300). The gaming machine presents the player with the opportunity to play a game, for example by placing a wager on the outcome of an event (step 302). The gaming machine may invite the player to wager varying amounts. For example in the case of a reel based game, the player may be presented with one or more win lines and provided with a choice of stakes, thereby providing the player with the choice of different wagering different amounts on each spin of the reels. Similarly in the case of a roulette style game, the player may be provided with a choice of staking level and the ability to choose a betting pattern of their own making.

Should the player choose to play the game, once a wager has been placed the gaming machine verifies with the server that the value of the wager placed does not exceed the value of credit available (step 304). If the value of the wager placed exceeds the value of credit available the gaming machine clears the wager placed and again invites the player to place a wager. Otherwise, the wager placed is allowed (step 306) and the game is played.

A determination of the success of the wager is then made by the processor (step 308) and a suitable signal then sent to the server 4 (step 310).

If the wager was successful, a signal is sent to increase the value of credit available in the database, this value of credit replacing the previous value of credit available in the database. If the wager was unsuccessful, a signal is sent to decrease the value of credit available in the database by the amount of the wager placed, this value of credit replacing the previous value of credit available in the database. In some cases, the result of the wager will be to return the wager. In these cases, a signal is sent either to increase or decrease the value of credit available by zero. It is advisable to return a signal since the absence of a signal may be interpreted as a failure, for example of the gaming machine or the network.

Figure 6:
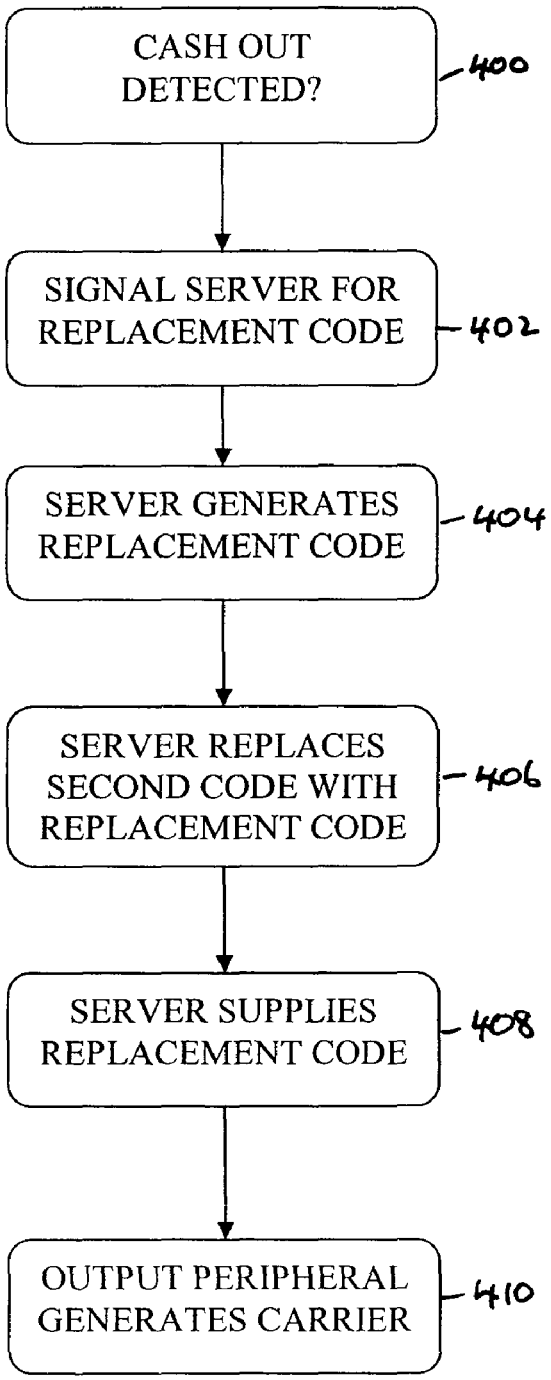
FIG. 6 shows a flowchart illustrating steps in the issuing a information carrier from a machine.

If the gaming machine does not detect selection of a game (for example by the placing of a wager) by the player, the gaming machine checks to determine if the player has requested a cashout (step 312). If not, the gaming machine again checks to determine if a game has been selected. If a cashout has been requested, a method to be described subsequently with reference to FIG. 6 is followed.

Figure 5B:
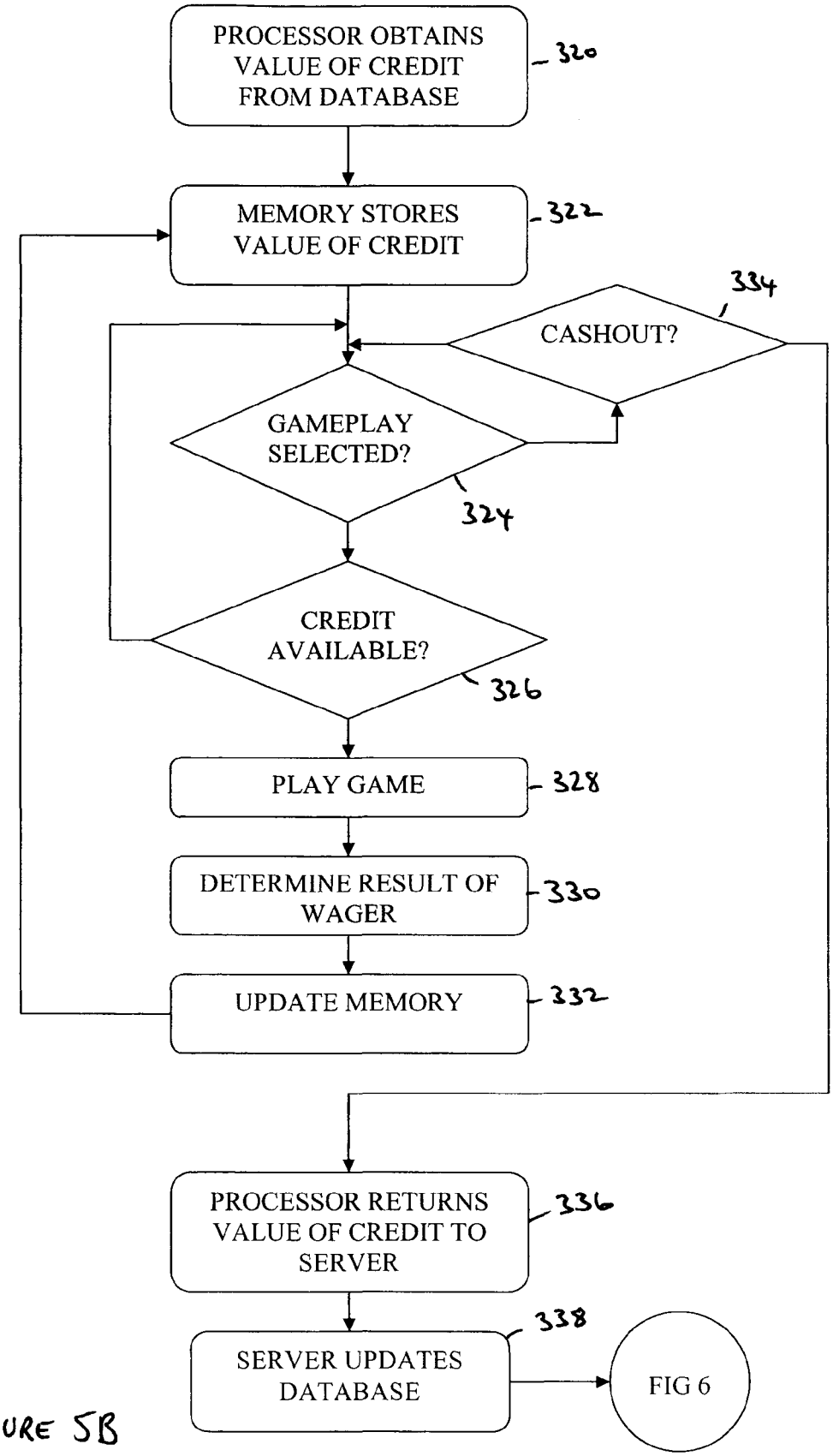
FIG. 5*b* shows a flow chart illustrating steps during play in a second embodiment of the present invention.

In a second embodiment (FIG. 5*b*) having validated the authenticity of the information carrier the processor communicates with the server to obtain the current value of credit from the database (step 320). The processor 20 then stores the value of credit in a suitable location in the local memory unit 34 (step 322). Any suitable form of memory may be used for this task.

The gaming machine 8 then presents the player with the opportunity to play a game, for example by placing a wager on the outcome of an event 324. The gaming machine may invite the player to wager varying amounts. Should the player choose to play the game once a wager has been placed, the processor checks that the value of the wager placed does not exceed the value of credit in the memory (step 326). If the value of the wager placed exceeds the credit available the processor clears the wager placed and again invites the player to place a wager. Otherwise, the wager placed is determined to be allowable and the game is played (step 328). A determination of the success of the wager is then made (step 330) and a suitable signal sent by the processor 20 to the local memory unit 34.

If the wager was successful, the processor 20 signals the local memory unit 34 to increase the value of credit stored in the local memory unit 34, this value of credit replacing the previous value of credit stored in the local memory unit 34. If the wager was unsuccessful, a signal is sent to decrease the value of credit available stored in the local memory unit 34 by the amount of the wager placed, this value of credit replacing the previous value of credit stored in the local memory unit 34. In some cases, the result of the wager will be to return the wager. In these cases, a signal is sent either to increase or decrease the value of credit stored in the local memory unit 34 by zero. It is advisable to return a signal since the absence of a signal may be interpreted as a failure, for example of the connection between the processor and the local memory unit 34.

The gaming machine 8 then again invites the player to play.

If the gaming machine does not detect selection of a game (for example by the placing of a wager) by the player, the processor 20 checks to determine if the player has requested a cashout (step 334). If not, the processor again checks to determine if a game has been selected. If a cashout has been requested, the processor signals the server with the value of credit stored in the memory unit 34 (step 336) and the server causes the database to be updated with this value of credit (step 338). A method to be described subsequently with reference to FIG. 6 is then followed. It will be understood that in this embodiment the database is updated only at the end of each session of play.

Figure 5C:
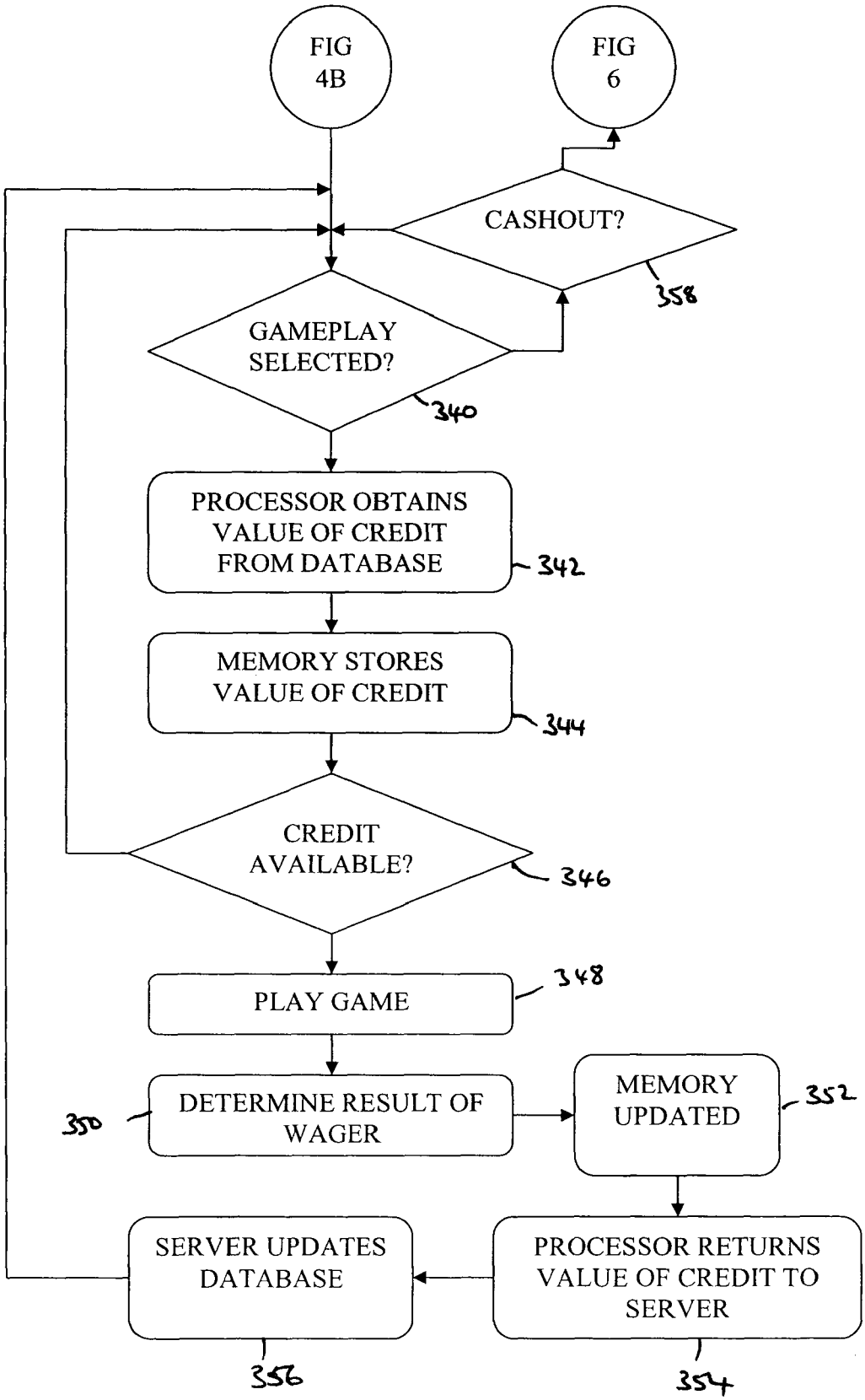
FIG. 5*c* shows a flow chart illustrating steps during play in a third embodiment of the present invention.

In a third embodiment (FIG. 5C) having validated the authenticity of the information carrier, the gaming machine then presents the player with the opportunity to play a game, for example by placing a wager on the outcome of an event (step 340).

The gaming machine may invite the player to wager varying amounts. Should the player choose to play the game once a wager has been placed, the processor 20 communicates with the server 4 to obtain the value of credit from the database (step 342). When the value of credit is returned, the processor stores the value of credit in the local memory unit 34 (step 344).

The processor 20 then checks that the value of the wager placed does not exceed the value of credit in the local memory unit (step 346). If the value of the wager placed exceeds the value of credit available the processor clears the wager placed and again invites the player to place a wager. Otherwise, the wager placed is determined to be allowable, and the game is played (step 348).

A determination of the success of the wager is subsequently made (step 350) and a signal sent to the local memory unit 34 (step 352).

If the wager was successful, the processor 20 signals the local memory unit 34 to increase the value of credit stored in the local memory unit 34, this value of credit replacing the previous value of credit stored in the local memory unit 34. If the wager was unsuccessful, a signal is sent to decrease the value of credit available stored in the local memory unit 34 by the amount of the wager placed, this value of credit replacing the previous value of credit stored in the local memory unit 34. In some cases, the result of the wager will be to return the wager. In these cases, a signal is sent either to increase or decrease the value of credit stored in the local memory unit 34 by zero. It is advisable to return a signal since the absence of a signal may be interpreted as a failure, for example of the connection between the processor and the local memory unit 34.

Once the local memory unit 34 has been updated, the processor 22 then signals the server 4 with the value of credit in the local memory unit 34 (step 354). The server 4 then causes the database to be updated with this value of credit (step 356). It will be understood that in this embodiment the database is updated following each play of the game.

If the gaming machine does not detect selection of a further game (for example by the placing of a wager) by the player, the processor 20 checks to determine if the player has requested a cashout (step 358). If not, the processor 20 again checks to determine if a further game has been selected. If a cashout has been requested, a method to be described subsequently with reference to FIG. 6 is then followed.

Preferably, when the value of credit remaining is zero, the gaming machine will be caused to generate a replacement information carrier, either at the request of the player or in response to detection of this condition by the gaming machine or server as the case may be. The player may then take this replacement information carrier to a cashier's desk or automated cashier terminal to provide additional value of credit to the player account, validating the provision of credit by confirming the first code. Alternatively, the gaming machine when provided with suitable credit units may invite the player to provide additional credit.

The cashout process will now be described by reference to FIG. 6. First it is necessary for the processor 20 to detect a cashout signal (step 400). Typically such a signal is generated in response to actuation of a suitable input means, such as a pressing a "collect" button. The "collect" button may conveniently take the form of an electro-mechanical peripheral or a suitably marked area of a touchscreen.

The processor 20 then signals the server 4 to request an updated second code (step 402). The updated second code is preferably provided by the code generator (step 404). The server 4 replaces the second code in the database with the updated second code (step 406) and supplies the updated second code to the processor 20 (step 408). The processor 20 then causes the output peripheral 28 to generate a new information carrier (step 410). The new information carrier bears coding identifying the replacement information carrier by reference to the updated second code. The coding may be an alphanumeric representation of the updated second code, a barcode representing the updated second code or another representation of the updated second code.

In an alternative embodiment, for example where the second code is used as the primary ID within the database, the updated second code is not generated, and the existing second code is used such that the replacement information carrier bears coding identifying the replacement information carrier by reference to the second code.

If the current value of credit is sufficient, the replacement information carrier may then be used to wager again, by inserting the replacement information carrier into a suitable credit peripheral of a gaming machine in the same way as has already been described. In this way the information carriers may be used as currency with which to wager. The player may also increase the value of credit in their account by inserting currency into the machine by way of a suitable credit peripheral.

Figure 7:
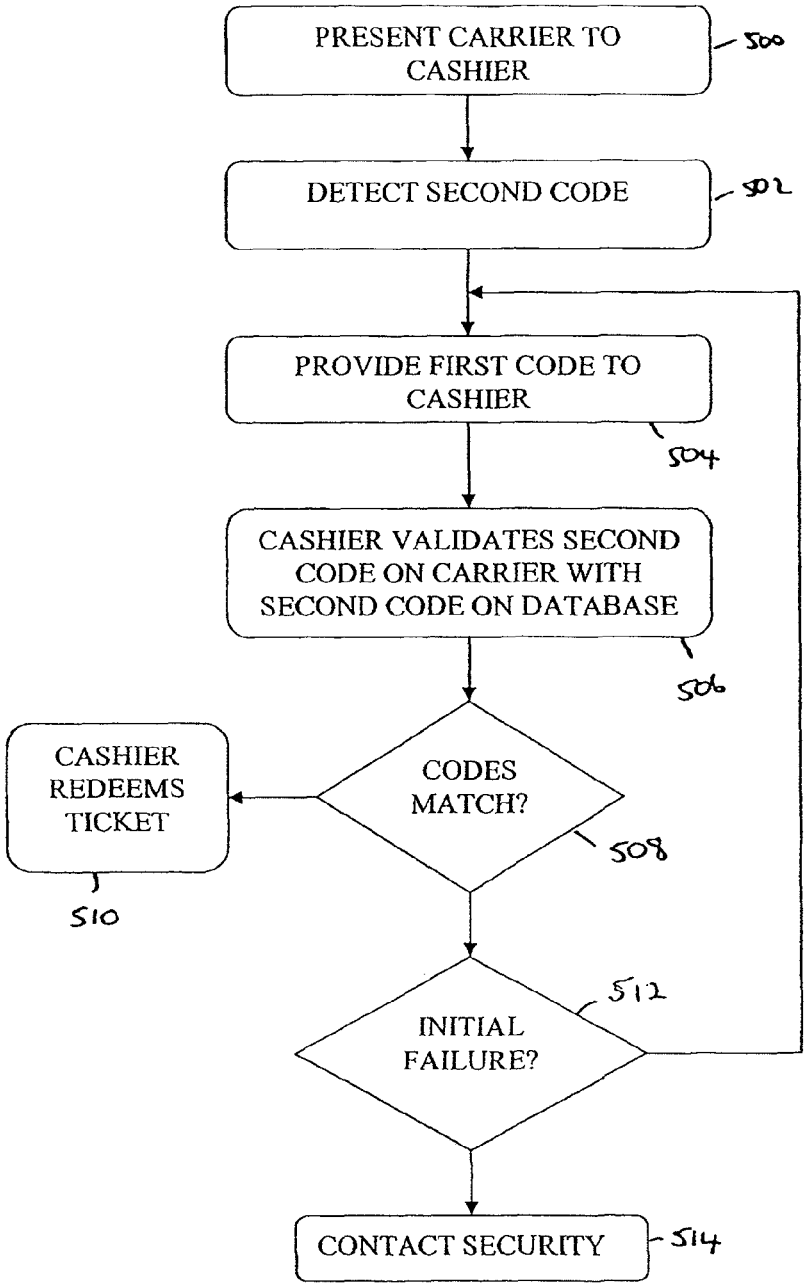
FIG. 7 shows a flowchart illustrating steps in information carrier redemption.

Alternatively, if the current value of credit is sufficient, the (replacement) information carrier may be redeemed. The replacement information carrier is provided to a cashier's desk or automated cashier machine (step 500, FIG. 7). The second (or updated second) code on the replacement information carrier is detected (step 502)

The player is then prompted for the first code. The first code may be provided by the player by use of any suitable input means (step 504).

The second (or updated second) code on the replacement information carrier is then compared against the second (or updated second) code recorded in the database against the first code (step 506). A determination is then made as to whether the codes match (step 508).

If the codes match the cashier redeems the replacement information carrier (step 510). Redemption may be by payment of currency, generating a cheque, or electronic transfer to a suitable bank account.

If the codes do not match, the player may again be prompted to enter the first code (step 512). However, to prevent fraud, the player is provided only with a set number of attempts to enter the first code correctly. If the set number of attempts is made and the first code not correctly entered, the replacement information carrier will be retained and a suitable information message communicated to the player. Additionally, the cashier or automated cashier may signal (by any suitable means) for security to attend (step 514).

While the invention has been described in detail and with reference to specific embodiments thereof, it will be apparent to one skilled in the art that various changes and modifications can be made therein without departing from the spirit and scope thereof.

The invention claimed is:

1. A method of gaming comprising the steps of:

a) a player registering with a gaming establishment, including providing a first code to the gaming establishment and a value of credit available with which to play;

b) a second code being generated;

c) the player being issued with an information carrier provided with the second code;

d) the player inserting the information carrier in a gaming machine, the gaming machine detecting the second code and requiring the player to enter a first code, and prior to gaming being permitted on the gaming machine one of the first code entered at the machine and the second code detected at the gaming machine being validated against the first code provided on registration and the generated second code;

e) the player subsequently indicating that no further gaming is intended;

f) an updated second code being generated; and g) the gaming machine issuing a replacement information carrier having an updated second code.

2. A method of gaming according to claim 1, in which for the player to redeem the replacement information carrier, the player must provide the first code.

3. A method according to claim 1, in which a server is provided and the server provides the second code, the server linking the second code and the first code in a database together with the amount of credit.

4. A method according to claim 3, in which the gaming machine interrogates the server to ensure the first code entered by the player at the gaming machine corresponds to the first code associated with the second code at the server.

5. A method according to claim 3, in which the gaming machine includes a local memory unit, the gaming machine interrogating the server to obtain the value of credit available with which to play, storing the value of credit available in the local memory unit and modifying the value of credit available in the local memory unit as required prior to the player indicating that no further gaming is intended.

6. A method according to claim 5, in which when the player indicates that no further gaming is intended, prior to issuing the replacement information carrier having the updated second code the gaming machine communicates a value of credit available to be returned to the server, the server updates the database to replace the value of credit available in the server with the value of credit available to be returned.

7. A method according to claim 6, in which the server generates the updated second code to be associated with the first code and the value of credit available to be returned and provides the updated second code to the gaming machine.

8. A method according to claim 1, in which the updated second code is the same as the second code.

9. A method according to claim 7, in which the gaming machine communicates the value of credit available to be returned to the server after each play of the gaming machine to enable updating of the database as well as when the player requests the value of credit available to be returned.

10. A method according to claim 9, in which the updated second code is generated and returned on each occasion the gaming machine communicates the value of credit available.

11. A method according to claim 2, in which a server is provided and the server provides the second code, the server linking the second code and the first code in a database together with the amount of credit.

12. A method according to claim 11, in which the gaming machine interrogates the server to ensure the first code entered by the player at the gaming machine corresponds to the first code associated with the second code at the server.

13. A method according to claim 4, in which the gaming machine includes a local memory unit, the gaming machine interrogating the server to obtain the value of credit available with which to play, storing the value of credit available in the local memory unit and modifying the value of credit available in the local memory unit as required prior to the player indicating that no further gaming is intended.

14. A method according to claim 13, in which when the player indicates that no further gaming is intended, prior to issuing the replacement information carrier having the updated second code the gaming machine communicates a value of credit available to be returned to the server, the server updates the database to replace the value of credit available in the server with the value of credit available to be returned.

15. A method according to claim 13, in which the server generates the updated second code to be associated with the first code and the value of credit available to be returned and provides the updated second code to the gaming machine.

16. A gaming system comprising:

a) a server including a database, the database storing information representative of at least one player, a first code associated with the or each player, a second code associated with the or each player, and a value of credit available with which to play associated with the or each player;

b) a network; and c) one or more gaming machines, each gaming machine having at least one credit peripheral for recognizing and validating a second code provided on an information carrier, at least one payment peripheral for issuing a replacement information carrier, a network communication unit to enable communication with the server over the network, at least first input means to enable the player to provide a first code entered by the player, and a processor for managing the operation of the gaming machine including communicating with the server over the network to validate at least one of the first code entered by the player and the second code provided on the information carrier against the first code associated with the player stored in the server and the second code associated with the player stored in the server.

17. A gaming system according to claim 16, in which on play of the gaming machine the value of credit available associated with the individual player is modified.

18. A gaming system according to claim 16, in which each gaming machine is provided with a local memory unit in which the value of credit available associated with the individual player is stored during play of the gaming machine by the player.

19. A gaming system according to claim 18, in which prior to issue of the replacement information carrier by the payment peripheral, the processor communicates the value of credit available associated with the individual player in the local memory unit to the server to update the value of credit available associated with the individual player stored in the server.

20. A gaming system according to claim 16, in which following each play of the gaming machine, the processor communicates with the server to update the value of credit available associated with the individual player stored in the server.

21. A gaming system according to claim 18 in which prior to issue of the replacement information carrier by the payment peripheral, the processor communicates with the server to obtain an updated second code for the replacement information carrier.

22. A gaming system according to claim 19, in which the updated second code for the replacement information carrier is identical to the second code associated with the individual player.

23. A gaming system according to claim 19, in which the updated second code for the replacement information carrier is generated by a random number generator.

24. A gaming system according to claim 23, in which the random number generator is located at the gaming machine and the processor communicates the updated second code to the server for the server to replace the second code in the database with the updated second code.

25. A gaming system according to claim 23, in which the random number generator is located with the server, the processor requesting the updated second code from the server and the server replacing the second code in the database with the updated second code.

26. A gaming system according to claim 17 in which each gaming machine is provided with a local memory unit in which the value of credit available associated with the individual player is stored during play of the gaming machine by the player.

27. A gaming system according to claim 26 in which prior to issue of the replacement information carrier by the payment peripheral, the processor communicates the value of credit available associated with the individual player in the local memory unit to the server to update the value of credit available associated with the individual player stored in the server.

28. A gaming system according to claim 17 in which following each play of the gaming machine, the processor communicates with the server to update the value of credit available associated with the individual player stored in the server.

29. A gaming system according to claim 19 in which prior to issue of the replacement information carrier by the payment peripheral, the processor communicates with the server to obtain an updated second code for the replacement information carrier.

30. A gaming system according to claim 20 in which prior to issue of the replacement information carrier by the payment peripheral, the processor communicates with the server to obtain an updated second code for the replacement information carrier.

31. A gaming system according to claim 28 in which prior to issue of the replacement information carrier by the payment peripheral, the processor communicates with the server to obtain an updated second code for the replacement information carrier.

32. A gaming system according to claim 20 in which the updated second code for the replacement information carrier is identical to the second code associated with the individual player.

33. A gaming system according to claim 21 in which the updated second code for the replacement information carrier is identical to the second code associated with the individual player.

34. A gaming system according to claim 29 in which the updated second code for the replacement information carrier is identical to the second code associated with the individual player.

35. A gaming system according to claim 30 in which the updated second code for the replacement information carrier is identical to the second code associated with the individual player.

36. A gaming system according to claim 31 in which the updated second code for the replacement information carrier is identical to the second code associated with the individual player.

37. A gaming system according to claim 20, in which the updated second code for the replacement information carrier is generated by a random number generator.

38. A gaming system according to claim 37 in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

39. A gaming system according to claim 21, in which the updated second code for the replacement information carrier is generated by a random number generator.

40. A gaming system according to claim 39, in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

41. A gaming system according to claim 28, in which the updated second code for the replacement information carrier is generated by a random number generator.

42. A gaming system according to claim 41, in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

43. A gaming system according to claim 29, in which the updated second code for the replacement information carrier is generated by a random number generator.

44. A gaming system according to claim 43, in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

45. A gaming system according to claim 30, in which the updated second code for the replacement information carrier is generated by a random number generator.

46. A gaming system according to claim 45, in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

47. A gaming system according to claim 31, in which the updated second code for the replacement information carrier is generated by a random number generator.

48. A gaming system according to claim 47, in which either the random number generator is located at the gaming machine and the processor communicates the updated second code to the server for the server to replace the second code in the database with the updated second code or the random number generator is located with the server, the processor requesting the updated second code from the server and the server replacing the second code in the database with the updated second code.

* * * * *